United States Patent [19]

Pillai

[11] Patent Number: 4,796,568

[45] Date of Patent: Jan. 10, 1989

[54] POWER PLANT BURNING FUEL IN A FLUIDIZED BED

[75] Inventor: Krishna K. Pillai, Finspong, Sweden

[73] Assignee: ABB Stal AB, Finspong, Sweden

[21] Appl. No.: 171,597

[22] Filed: Mar. 22, 1988

[30] Foreign Application Priority Data

Mar. 25, 1987 [SE] Sweden ..... 8701228

[51] Int. Cl.[4] ..... F22B 1/00

[52] U.S. Cl. ..... 122/4 D; 110/245; 165/104.16

[58] Field of Search ..... 122/4 D, 479; 165/104.16; 110/245

[56] References Cited

U.S. PATENT DOCUMENTS

| | | | |
|---|---|---|---|
| 4,397,267 | 8/1983 | Fink . | |
| 4,530,207 | 7/1985 | Brannstrom . | |
| 4,584,949 | 4/1986 | Brannstrom | 122/4 D X |
| 4,640,205 | 2/1987 | Brannstrom . | |
| 4,665,864 | 5/1987 | Seshamahi et al. | 122/4 D |
| 4,753,180 | 6/1988 | Narisoko et al. | 110/346 |

FOREIGN PATENT DOCUMENTS

| | | | |
|---|---|---|---|
| 0068301 | 6/1982 | European Pat. Off. . | |
| 2935542 | 3/1980 | Fed. Rep. of Germany . | |
| 435545 | 10/1984 | Sweden . | |
| 441698 | 10/1985 | Sweden . | |
| 0734477 | 5/1980 | U.S.S.R. | 122/4 D |

*Primary Examiner*—Edward G. Favors

*Attorney, Agent, or Firm*—Pollock, Vande Sande & Priddy

[57] ABSTRACT

A steam-generating plant burning a fuel, primarily coal, in a fluidized bed has the bed vessel divided into a combustion chamber and an ash chamber by an air distributor with nozzles for the supply of air for fluidization of the bed and combustion of the fuel. The air distributor is provided with openings, through which bed material can pass from the fluidized combustion chamber to the non-fluidized ash chamber. Tubes for generating steam are provided in the combustion chamber and tubes for superheating steam are arranged in the ash chamber. The plant is provided with a transport means for conveying bed material back from the ash chamber to the combustion chamber. Regulating the quantity of bed material fed back to the combustion chamber also regulates the supply of heat to the superheating tubes and controls the degree of superheating obtained.

10 Claims, 1 Drawing Sheet

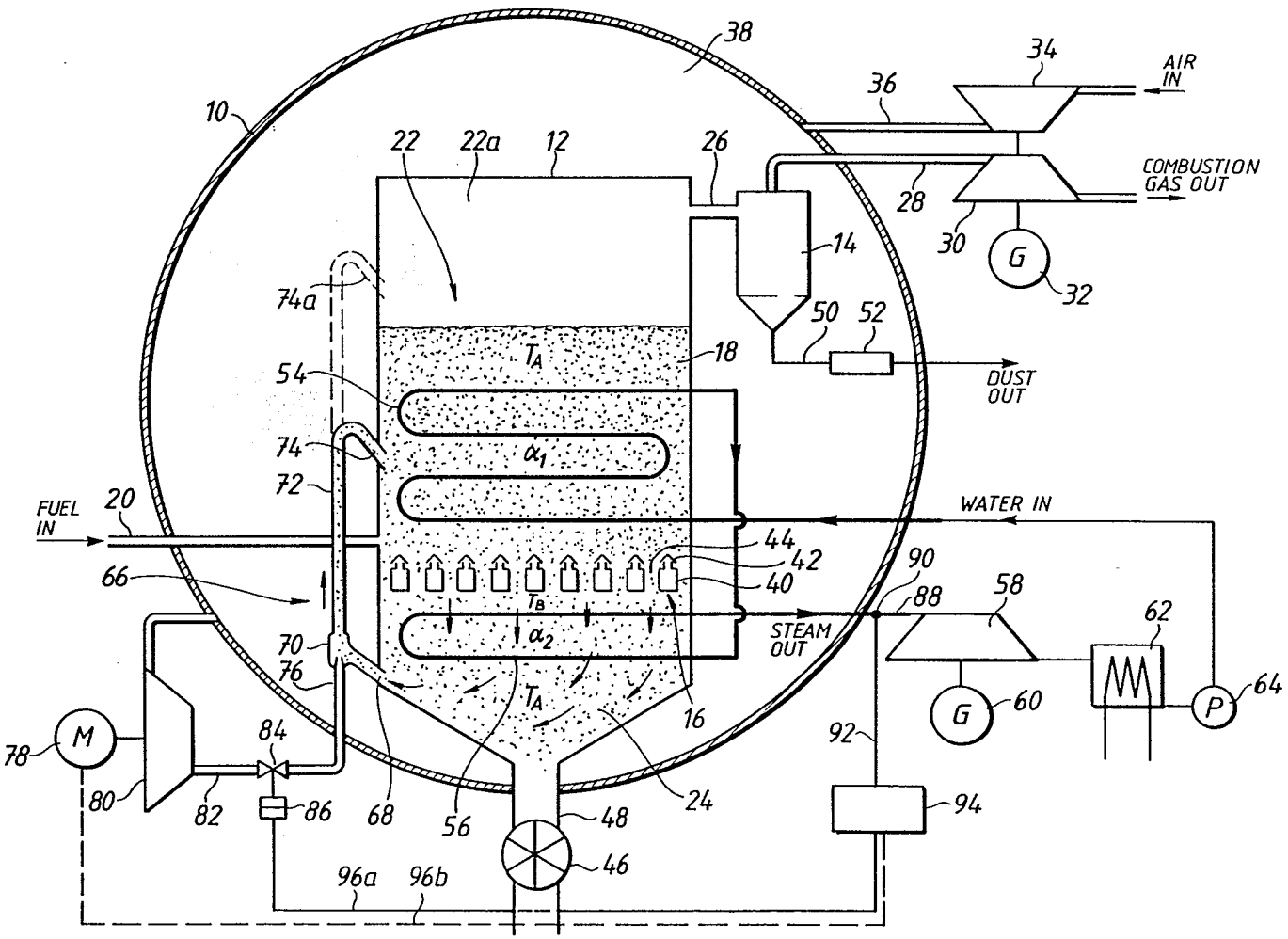
AIR IN
COMBUSTION GAS OUT
DUST OUT
WATER IN
STEAM OUT
FUEL IN
G
P
M
$T_A$
$T_B$
$\alpha_1$
$\alpha_2$
10
12
14
16
18
20
22
22a
24
26
28
30
32
34
36
38
40
42
44
46
48
50
52
54
56
58
60
62
64
66
68
70
72
74
74a
76
78
80
82
84
86
88
90
92
94
96a
96b

POWER PLANT BURNING FUEL IN A FLUIDIZED BED

TECHNICAL FIELD

This invention relates to a power plant burning fuel in a fluidized bed of particulate material (e.g. such as limestone or dolomite which also serves as sulfur absorbent). The bed is located in a bed vessel and steam, is generated from water fed to tubes in the bed. The invention can be applied to a plant operating at approximately atmospheric pressure and generating steam for heating or to drive a steam turbine. However, it is primarily designed for a power plant operating at a pressure considerably exceeding atmospheric pressure, known as a PFBC (Pressurized Fluidized Bed Combustion) power plant.

The bed vessel and gas cleaning equipment in PFBC plant are usually enclosed in a pressure vessel. Combustion gases from the bed vessel drive one or more gas turbines and superheated steam is generated in tubes in the bed of the bed vessel, this superheated steam driving one or more steam turbines. One object of the invention is to reduce the thermal stresses in the superheating tubes of the plant, thus enabling superheating to extremely high temperatures (e.g. 550° to 600° C.). Another object of the invention is to achieve improved control properties for such steam-generating plant particularly at partial load.

SUMMARY OF THE INVENTION

According to the invention at least the final stage of superheating or intermediate superheating between two turbine stages is effected in an ash chamber below the air distributor of the bed vessel, openings being provided in the air distributor for the downward passage of bed material, the plant also being provided with transport means for conveying bed material upwardly from the ash chamber back to the combustion chamber of the bed vessel.

The transport means effects circulation of bed material so that the flow of bed material down through the air distributor and past the superheating tubes can be regulated, and thus also the supply of heat to the superheating tubes. Since the bed material contacting the superheating tubes is not in fluidized state, the heat-transfer coefficient will be considerably lower than in that existing in the fluidized bed material. The surface temperature of the tubes in the ash chamber will thus be lower than it would have been had the tubes been located in the fluidized material in the upper part of the bed. The thermal stress in the tube wall is also reduced. The invention is particularly of value when superheating to high temperatures is required. Overheating here shall be taken to mean superheating to 550° to 600° C.

BRIEF DESCRIPTION OF THE DRAWING

The invention will now be described more fully, by way of example, with reference to the accompanying drawing, the sole FIGURE of which shows schematically the invention applied to a PFBC power plant.

DESCRIPTION OF PREFERRED EMBODIMENT

In the schematic drawing of the power plant 10 designates a pressure vessel. A bed vessel 12 and gas-cleaning plant (symbolized by a cyclone 14) are arranged in the pressure vessel. In reality the gas-cleaning plant would comprise parallel-connected groups of seriesconnected cyclones, but for convenience only a single cyclone has been shown. In the lower part of the bed vessel 12 is a distributor 16 to disperse air for fluidization of a bed 18 of particulate material and for combustion of a fuel supplied to the bed 18 through a fuel-supply pipe 20. The air distributor 16 divides the bed vessel 12 into an upper combustion chamber 22 and a lower ash chamber 24. The upper part of the combustion chamber 22 forms a freeboard **22*a* where combustion gases from the bed 18 collect. These gases are conducted from the vessel 12 via a conduit 26 to the cyclone 14. Dust separated in the cyclone 14 is removed through a pipe 50 and a pressure-reducing dust discharge device 52 for collection in a container (not shown) outside the pressure vessel. The cleaned gas is conducted through a pipe 28 to a gas turbine 30 which drives an electrical generator 32 and an air compressor 34. The compressor 34 compresses air to a supra-atmospheric pressure which is supplied through a pipe 36 to a space 38 between the pressure vessel 10 and the bed vessel 12 and serves as combustion air for the fuel. The air distributor 16 is constructed of a plurality of elongated distribution chambers 40 each provided with spaced-apart nozzles 42. Air for fluidization and combustion is supplied to these distribution chamgers 40 from the space 38 via valve members or dampers, not shown, which determine the volume of air flow. The distribution chambers 40 define between them slits 44 through which bed material can flow from the bed 18 in the combustion chamber 22 to an ash chamber 24. The bed material, sulfur absorbent and residual products from the combustion process are removed from the ash chamber through a cell-feeder 46 in a discharge pipe 48**.

Tubes 54 are provided in the bed 18 in the combustion chamber 22, and are flooded with water to generate steam and to cool the bed. Further tubes 56 are provided in the ash chamber 24 in series with the tubes 54 for superheating this steam. The steam drives a steam turbine 58 and an electrical generator 60 connected thereto. The steam leaving the turbine 58 is condensed in a condenser 62 and the condensate is returned by a feed-water pump 64 to the tubes 54 in the bed 18. Alternatively the tubes 56 may constitute an intermediate superheater between two stages in the turbine 58.

A pneumatic transport means 66 is provided in the plant to carry bed material up from the ash chamber 24 to the combustion chamber 22 so that it can be circulated between these chambers. This transport means 66 includes a suction nozzle 68, an ejector 70, a pipe 72 and a supply nozzle 74 with its orifice in the bed 18, or in the freeboard **22*a* as indicated by broken lines 74a. Due to the pressure drops occurring in the nozzles 42 and in the bed 18, the pressure in the space 38 is higher than at the orifice of the supply nozzle 74. The ejector nozzle 76 can therefore obtain transport air directly from the space 38 through a control valve or, as shown in the drawing, via a booster compressor 80 driven by a motor 78. In a pipe 82 connecting the compressor 80 to the ejector nozzle 76 is a throttle-valve 84 for regulating the gas flow and thus the rate at which bed material is recycled. Alternatively, bed material flow may be regulated by controlling the speed of the compressor 80. The valve 84 is operated by a control device 86. In the steam pipe 88 is a temperature sensing device 90 which measures the temperature of the steam supplied to the turbine 58. This temperature sensing device 90 communicates via a link 92 (e.g. a cable) with control equipment 94 where the actual value of the signal from the device 90 is compared with a set value. The control equipment is connected either to the operating device 86 of the valve 84 by a cable 96***a* or to speedcontrol equipment in the motor 78 by a cable 96*b*. The flow of transport gas to the transport means 66 is controlled either by varying the through-flow area of the valve 84 or by varying the speed of the motor 78 and compressor 80.

In a fluidized bed, the temperature $T_B$ is usually in the range 800° to 900° C. Steam generated in the tubes 54 in the bed acquires a temperature of up to about 500° C. In a fluidized bed the heat-transfer coefficient $\alpha_1$ between a fluidized bed and a tube passing therethrough is extremely high ($\alpha_1$ could lie in the range 300 to 500 $W/m^2K$). This causes a high surface temperature on the tubes, high thermal flux in the tube wall and high specific effect. It also entails high thermal stress in the tubes and certain control problems. The steam temperature should therefore be limited to below 500° C. Desired superheating to 550° to 600° C. therefore entails particular problems and these problems are especially noticeable at partial load.

The bed material in the ash chamber 24 is not in a fluidized state. The heat-transfer coefficient $\alpha_2$ between non-fluidized bed material and a tube embedded therein (i.e. the tubes 56) is therefore considerably lower than the heat-transfer coefficient $\alpha_1$ in the fluidized bed 18 in the combustion chamber 22 above the air distributor 16. The heat-transfer coefficient $\alpha_2$ could lie in the range 30 to 100 $W/m^2K$. This lower value for $\alpha_2$ results in greatly reduced thermal stress in the tubes 56 compared to that arising in the tube 54. The steam temperature can simply be regulated by regulating circulation of the bed material between the combustion chamber 22 and the ash chamber 24. Bed material supplied to the ash chamber 24 has the temperature $T_B$ (i.e. 800° to 900° C.). The flow of bed material past the tubes 56 determines the heat supply to the super-heating part of the ash chamber. Bed material which has passed the tubes 56 is cooled to a temperature $T_A$. Cooling to about 600° C. or lower is possible in this lower region of the ash chamber. Further ash coolers can be provided in the ash chamber for additional cooling of the material prior to its removal through the cell feeder 46, but these are not shown in the drawing.

The arrangement disclosed and illustrated is capable of wide variation and modifications and changes to the illustrated arrangement are within the ambit of this invention if they fall within the spirit and scope of the following claims.

What is claimed is:

1. A power plant burning fuel in a fluidized bed of particulate material comprising a bed vessel, means to supply fuel to the bed vessel, an air distributor with nozzles for blowing air into the bed vessel to effect fluidization of the bed material and combustion of the fuel supplied to the bed, said air distributor dividing the bed vessel into a combustion chamber in which the air is blown and an ash chamber in which it is not, openings in the air distributor permitting bed material to flow from the combustion chamber to the ash chamber, first tubes in the bed in the combustion chamber and means to supply water to said first tubes for generating steam therein, characterized in that the plant also includes second tubes for superheating steam, arranged in the ash chamber, a pneumatic transport means for conveying material from the ash chamber to the combustion chamber, a temperature-sensing device for sensing the temperature of the superheated steam, and control equipment regulating the flow of transport gas to said pneumatic transport means on the basis of a temperature-dependent signal received from said temperature sensing device.

2. A power plant as claimed in claim 1, wherein the bed vessel is enclosed in a pressure vessel and combustion of the fuel takes place at a supre-atmospheric pressure.

3. A power plant as claimed in claim 1, in which the means for conveying material from the ash chamber to the combustion chamber includes an ejector which draws bed material from the ash chamber and a pipe leading from the ejector to the combustion chamber.

4. A power plant as claimed in claim 3, in which the pipe has an outlet end that opens into the bed of particulate material.

5. A power plant as claimed in claim 3, in which the pipe has an outlet end that opens into the bed vessel at a level which is above the normal level of fluidized bed material.

6. A power plant as claimed in claim 2, in which the bed vessel is contained in a pressurized air-filled space and air from the said space is used as transport gas in the pneumatic transport means for conveying bed material from the ash chamber to the combustion chamber.

7. A power plant as claimed in claim 6, further including a booster compressor which increases the pressure of the transport gas above that existing in the said space.

8. In a pressurized fluidized bed combustion plant which includes a bed vessel containing fluidized fuel and particulate bed material, with the bed divided into an upper fluidized bed region and a lower non-fluidized ash chamber region which receives hot bed material from the upper region, and with heat-exchange tubes embedded in the upper region to generate steam from water fed therethrough, the improvement of superheating the steam by passing it through further heat-exchange tubes embedded in the lower region and providing means to recycle bed material from the ash chamber back to the fluidized bed region.

9. A PFBC plant as claimed in claim 8, in which the fuel is coal.

10. A PFBC as claimed in claim 9, in which the recycling means is a pneumatic transport arrangement.

* * * * *